US007389647B1

(12) United States Patent
Abraham, III

(10) Patent No.: US 7,389,647 B1
(45) Date of Patent: Jun. 24, 2008

(54) CLOSED SYSTEM AND METHOD FOR COOLING AND REMOTE DISPENSING OF BEVERAGES AT GUARANTEED TEMPERATURES

(76) Inventor: Martin Joseph Abraham, III, 2 Forestwood Ct., Slidell, LA (US) 70458

( * ) Notice: Subject to any disclaimer, the term of this patent is extended or adjusted under 35 U.S.C. 154(b) by 372 days.

(21) Appl. No.: 11/202,758

(22) Filed: Aug. 12, 2005

(51) Int. Cl.
*B67D 5/62* (2006.01)

(52) U.S. Cl. ..... 62/98; 62/390; 62/434

(58) Field of Classification Search ..... 62/389–390, 62/434–435, 98; 165/166–167
See application file for complete search history.

(56) References Cited

U.S. PATENT DOCUMENTS

| | | | | |
|---|---|---|---|---|
| 2,076,922 | A | 4/1937 | Simard | |
| 2,141,221 | A | 12/1938 | Panagopoulos | |
| 2,253,940 | A | 8/1941 | Peet | |
| 2,342,299 | A | 2/1944 | Peet | |
| 2,532,118 | A * | 11/1950 | Nicholson | 222/133 |
| 2,618,938 | A * | 11/1952 | Booth et al. | 62/64 |
| 2,646,667 | A * | 7/1953 | Kromer | 62/99 |
| 4,437,319 | A | 3/1984 | Iannelli | |
| 4,676,400 | A | 6/1987 | Lamont et al. | |
| 4,679,408 | A | 7/1987 | Nelson | |
| 5,009,082 | A * | 4/1991 | Abraham, III | 62/390 |
| 5,249,710 | A * | 10/1993 | Hassell et al. | 222/146.6 |
| 6,553,782 | B1 | 4/2003 | Kyees | |
| 6,598,417 | B1 | 7/2003 | Wilkes | |
| 6,609,391 | B2 | 8/2003 | Davis | |
| 6,698,229 | B2 * | 3/2004 | Renken et al. | 62/390 |
| 2003/0211219 | A1 | 11/2003 | Scullion et al. | |
| 2004/0098991 | A1 | 5/2004 | Heyes | |

OTHER PUBLICATIONS

"WTT—Brazed Plate Heat Exchangers—New Series TD," copyright 2003 by WTT America Inc.
"WTT—Brazed Plate Heat Exchangers—Series AE," copyright 2002 by WTT America Inc.

* cited by examiner

*Primary Examiner*—William E Tapolcai
(74) *Attorney, Agent, or Firm*—Lisa Velez

(57) ABSTRACT

A closed system and method of cooling and remote dispensing beverages (alcoholic or non-alcoholic) to a remote dispensing tower. The closed system employs a closed and sealed loop of continuously circulating coolant. The continuously circulating coolant is daisy chained through a bank of heat exchangers in the closed and sealed loop. Each heat exchanger flash chills a corresponding one beverage to be dispended at the remote dispensing tower via a primary trunk line. The primary trunk line communicates the flash chilled beverage in heat exchange relationship with a supply line of said coolant.

13 Claims, 6 Drawing Sheets

CLOSED SYSTEM AND METHOD FOR COOLING AND REMOTE DISPENSING OF BEVERAGES AT GUARANTEED TEMPERATURES

BACKGROUND OF THE INVENTION

1. Field of the Invention

The present invention relates to the cooling and dispensing of alcoholic and/or non-alcoholic beverages, and particularly to a closed system for cooling and remote dispensing that employs thermal heat exchangers in the cooler to rapidly ramp-up (flash chilling) the temperature of the beverage using the temperature of the coolant on the return line or the supply line.

2. General Background

Many commercial establishments serve draft beer at a bar area which is located some distance from the storage container, usually housed in a walk-in cooler or the like wherein the beer is kept at a refrigerated temperature with the surrounding cool air. Many restaurants, for example, will maintain multiple kegs of beer in a walk-in cooler. These walk-in coolers typically have their own heat exchanger which hopefully keeps the interior airspace of the cooler, for example, at 35° F.-40° F. so that anything contained within this walk-in cooler assumes the temperature of the surrounding air-cooled environment. A problem occurs wherein the walk-in cooler is used extensively, such as during peak operating hours. When this extensive use occurs, the door to the walk-in cooler is opened and closed repeatedly, causing the temperature of air within the cooler to rise which results in a rise of the temperature of goods (e.g., beer kegs) contained within the cooler. Thus, for example, if the cooler is subjected to extensive opening, the temperature of the beer inside the kegs which are housed in the cooler can rise to a beginning temperature of 50° F.-60° F. or higher. This beginning temperature for the beer at the keg (the temperature of the cooler) will result in warmer product at the spigot of a remote dispensing tower where the beer is dispensed to the user. More specifically, a warmer carbonated beverage, such as beer, when poured at the spigot is foam, such foam is discarded generating lost profits for the owners.

Furthermore, a temperature of 32° F. (or less) cannot be achieved at the spigot using cooling via glycol flowlines when distances are relatively short, such as less the 75 ft., even if the cooler is maintained at 40° F. More specifically, cooling using glycol flowlines requires a minimum cooling distance of approximately 75 feet to provide the necessary heat exchange between the glycol and the beverage lines when the cooler has an ambient temperature of 40° F. However, as the cooler temperature rises or as high volumes of products are dispensed, the beverage temperature at the spigot is affected such that foam is dispensed.

A system for cooling beer for remote dispensing is described in U.S. Pat. No. 5,009,082, by the same inventor, and is incorporated herein by reference as if set forth in full below. My prior system is an open system such that one stage of heat exchange takes place in an open bath of glycol (coolant). I have determined that in the open bath, the glycol is subject to dilution, as it absorbs water from humidity in the air. Thus, the open system required routine maintenance to replace the glycol. The open bath heat exchanger used coils. However, the main chiller, using a double pass copper evaporator coil, was limited in capacity to approximately 10 coils of product. Thus, for restaurants or bars with a larger beverage selection, multiple main chillers were needed which required extra real estate in the restaurant or bar, as well as, in the transportation vehicle shipping the system for initial installation.

Other known systems use a method of heat exchanging that also submerges the heat exchanger in a bath of coolant. Moreover, other systems employ a non-food grade coolant which presents environmental issues and is typically corrosive.

In view of the above, there is a continuing need for an improved system for cooling and remote dispensing beverages, such as, without limitation, domestic beer, European beer, stouts, Ale, Vodka, Margarita Mixes, that is to be dispensed from a container housed in a preliminary air-cooled environment, such as a walk-in cooler, or outside of a cooler.

Another continuing need is for a closed system for cooling and remote dispensing beverages that readily adapts to fluctuations in a cooler so that a beverage temperature at the spigot can be guaranteed without regard to fluctuation in the cooler's temperature. Thus, there is little to no waste produced.

There is a still further continuing need for a closed system for cooling and remote dispensing beverages at a guaranteed beverage temperature while eliminating the minimum cooling distance or dedicated cooler to store the beverages.

There is a still further continuing need for a closed system for cooling and remote dispensing beverages that employs a closed and sealed loop of circulating coolant for performing two stages of heat exchange.

There is a still further continuing need for a closed system for cooling and remote dispensing beverages that does not submerge individual heat exchangers in the coolant but instead, vertically mounts the heat exchangers to a wall in the cooler in close proximity to the beverage container.

As will be seen more fully below, the present invention is substantially different in structure, methodology and approach from that of other systems for cooling and remote dispensing of beverages.

SUMMARY OF THE PRESENT INVENTION

Broadly, the present invention contemplates a closed cooling and remote dispensing system for dispensing a plurality of beverages, each beverage may be alcoholic or non-alcoholic and is stored in a corresponding container remote from a dispensing tower, comprising: a main chiller for chilling a coolant for circulation in a closed and sealed loop to and from said tower; a primary trunk coupled in said closed and sealed loop, said primary trunk bundling supply and return lines of said coolant and product lines for delivering the plurality of beverages in heat exchange relationship with said coolant to said tower; and, a heat exchanger coupled in said closed and sealed loop and in fluid communication to receive a corresponding one beverage for flash chilling a temperature of the corresponding one beverage to a temperature of the coolant in said closed and sealed loop before the corresponding one beverage enters a corresponding one product line of said primary trunk.

Furthermore, the present invention contemplates a method of cooling and remote dispensing a plurality of beverages, each beverage may be alcoholic or non-alcoholic and is stored in a corresponding container remote from a dispensing tower, comprising the steps of:

- chilling a coolant for circulation in a closed and sealed loop;
- heat exchanging, in said closed and sealed loop, a bundle of supply and return lines of said coolant and product lines of the plurality of beverages to the tower; and, flash chilling a corresponding one beverage to a temperature of the coolant in said closed and sealed loop.

Moreover, the present invention contemplates a heat exchanger for use in a closed cooling and remote beverage dispensing system, comprising: a first plurality of plated dividers spreading a circulating coolant into a first set of thin sheets of liquid; a first pair of in-out ports for fluid communication with said circulating coolant through said first plurality of plated dividers; a second plurality of plated dividers spreading a beverage into a second set of thin sheets of liquid; and, a second pair of in-out ports for fluid communication of said beverage wherein said first plurality of plated dividers and said second plurality of plated dividers are in heat exchange relationship, and the first plurality of plated dividers and said second plurality of plated dividers are constructed and arranged to flash chill said beverage at a rate of at least 16 gallons/hr. and remove 2296 BTUs for a delta temperature (ΔT) of 18° F. between input and output beverage temperatures.

In view of the above, it is an object of the present invention to provide a closed system for cooling and remote dispensing beverages, such as, without limitation, domestic beer, European beer, stouts, Ale, Vodka, Margarita Mixes, that is to be dispensed from a container housed in a preliminary air-cooled environment, such as a walk-in cooler, or outside via a single trunkline.

Another object of the present invention is to provide a closed system for cooling and remote dispensing beverages that readily adapts to fluctuations in a cooler so that a beverage temperature at the spigot can be guaranteed without regard to fluctuation in the cooler's temperature and with little to no waste produced.

A still further object of the present invention is to provide a closed system for cooling and remote dispensing beverages at a guaranteed beverage temperature at shorter distances which eliminates the minimum cooling distance. Minimizing the trunkline length reduces the overall load on the main chiller of the coolant.

A still further object of the present invention is to provide a closed system for cooling and remote dispensing beverages that is sealed wherein the glycol or coolant is not exposed to air. Thereby, the glycol or coolant not subject to dilution.

A still further object of the present invention is to provide a closed system for cooling and remote dispensing beverages using thermal heat exchangers that flash chill beverages stored in containers directly after the beverage is siphoned, by the gas/pump control unit, from the container to the temperature of the coolant return line or supply line.

A still further object of the present invention is to provide a closed system for cooling and remote dispensing beverages that uses thermal heat exchangers that flash chills beverages stored in containers prior to the beverage being communicated to the tower wherein an open bath of the glycol is eliminated.

A still further object of the present invention is to provide a closed system for cooling and remote dispensing beverages wherein the main chiller utilizes a plated evaporator for chilling the coolant.

A still further object of the present invention is to provide a closed system for cooling and remote dispensing beverages that does not submerge the individual heat exchangers in a coolant but instead, vertically mounts the heat exchangers to a wall in the cooler.

In view of the above objects, a feature of the present invention is to provide a closed system for cooling and remote dispensing beverages that employs thermal heat exchangers that require no electricity or other power source.

Another feature of the present invention is to provide a closed system for cooling and remote dispensing beverages that employs thermal heat exchangers that can be easily mounted in the walk-in cooler and can be selectively and individually place on different product lines.

Another feature of the present invention is to provide a closed system for cooling and remote dispensing beverages that employs thermal heat exchangers that can be placed in either the return line or the supply line.

A still feature of the present invention is to provide a closed system for cooling and remote dispensing beverages that employs thermal heat exchangers that are compact.

A still further feature of the present invention is to provide a closed system for cooling and remote dispensing beverages that is efficient and economical to use.

A still further feature of the present invention is to provide a closed system for cooling and remote dispensing beverages that requires very little maintenance.

The above and other objects and features of the present invention will become apparent from the drawings, the description given herein, and the appended claims.

BRIEF DESCRIPTION OF THE DRAWINGS

For a further understanding of the nature, objects, and advantages of the present invention, reference should be had to the following detailed description, taken in conjunction with the accompanying drawings, in which like reference numerals denote like elements, and wherein.

DETAILED DESCRIPTION OF THE PREFERRED EMBODIMENT

Figure 1:
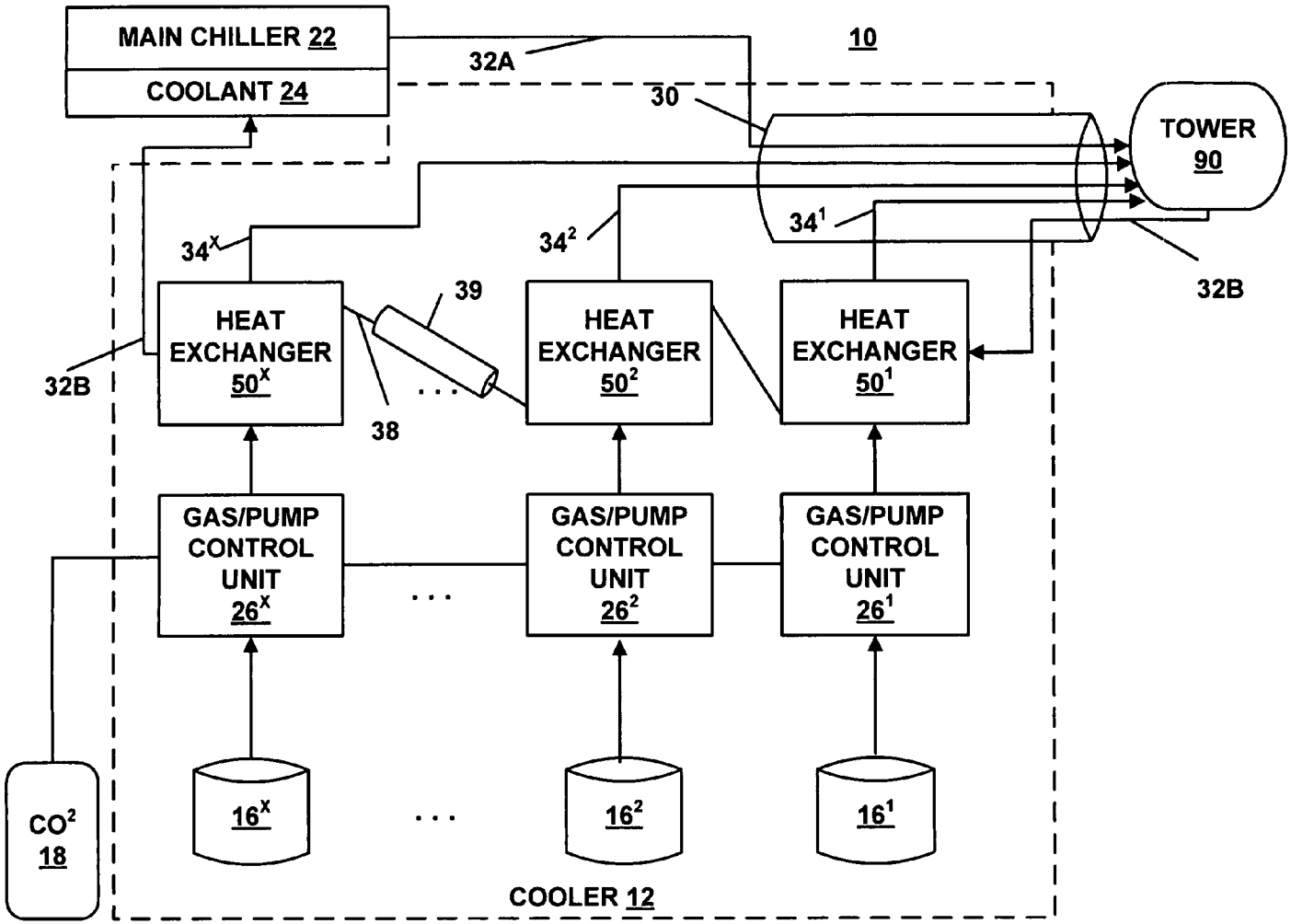
FIG. 1 is a general schematic diagram of the closed cooling and remote dispensing system in accordance with the present invention.
Figure 2:
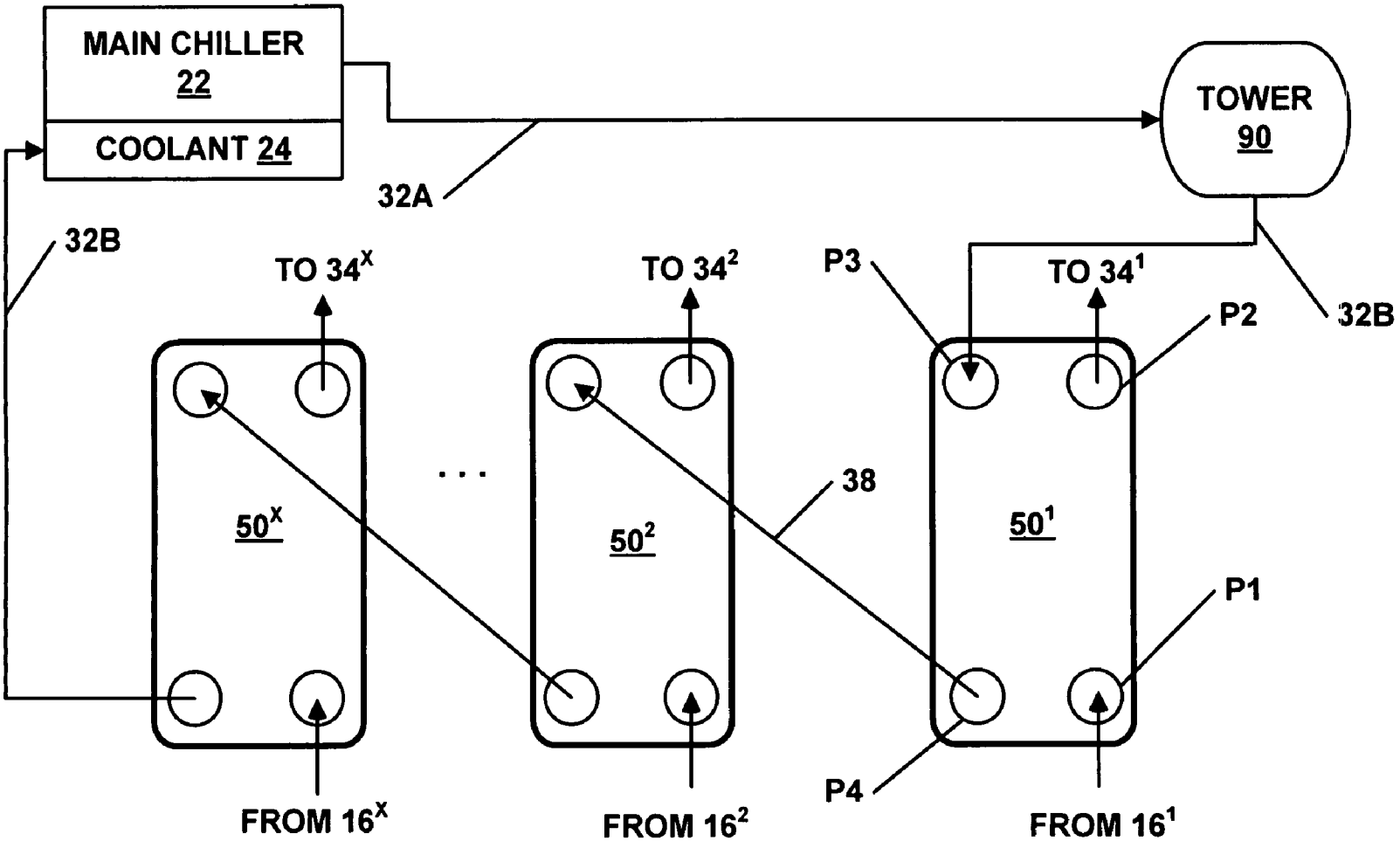
FIG. 2 is a diagram of the fluid communications in the closed cooling and remote dispensing system in accordance with the present invention.

Referring now to FIGS. 1 and 2, the closed cooling and remote dispensing system of the present invention will generally be referenced by the numeral 10. The closed cooling and remote dispensing system 10 is typically used in combination with a walk-in cooler 12 which is air-cooled and commonly installed in restaurants, bars and the like. A plurality of containers $\mathbf{16}^1$, $\mathbf{16}^2$ . . . $\mathbf{16}^X$ in the form of kegs of beer, for example, are contained within cooler 12 and the beverage contained within each container $\mathbf{16}^1$, $\mathbf{16}^2$ . . . $\mathbf{16}^X$ assumes the temperature of within cooler 12 wherein X is the number of beverage containers to be delivered at a guaranteed temperature of 32° F. (or less) or any other desired temperature. The cooling and remote dispensing system 10 of the present invention improves upon existing technology and provides flash chilling of the beverages using heat exchangers $\mathbf{50}^1$, $\mathbf{50}^2$ . . . $\mathbf{50}^X$ installed in the cooler 12.

The cooling and remote dispensing system 10 includes a main chiller 22 for cooling a coolant 24 adapted to be circulated along the coolant supply line 32*a* of a primary trunk 30 in a closed and sealed loop. The primary trunk 30 bundles together beverage lines $\mathbf{34}^1$, $\mathbf{34}^2$ . . . $\mathbf{34}^X$ from containers $\mathbf{16}^1$, $\mathbf{16}^2$ . . . $\mathbf{16}^X$ whereby the coolant supply line 32*a* and the beverage lines $\mathbf{34}^1$, $\mathbf{34}^2$ . . . $\mathbf{34}^X$ are in close heat exchange relationship. This heat exchange relationship provides a second heat exchange stage using the coolant temperature of the supply line 32*a*. The main chiller 22 is adapted to be installed outside of the cooler 12. While, the description herein addresses the use of a plurality of heat exchangers, if there is only one beverage from one container that require flash chilling, then only one heat exchanger would be needed.

In the cooler, 12, gas/pump control units $\mathbf{26}^1$, $\mathbf{26}^2$ . . . $\mathbf{26}^X$ are installed on the wall near containers $\mathbf{16}^1$, $\mathbf{16}^2$ . . . $\mathbf{16}^X$ and control the flow of beverages (with or without $CO^2$ 18) from containers $\mathbf{16}^1$, $\mathbf{16}^2$ . . . $\mathbf{16}^X$ as the beverages are dispensed at the remote dispensing tower 90. Each container $\mathbf{16}^1$, $\mathbf{16}^2$ . . . $\mathbf{16}^X$ is coupled to a corresponding one control unit $\mathbf{26}^1$, $\mathbf{26}^2$ . . . $\mathbf{26}^X$. Each corresponding one control unit $\mathbf{26}^1$, $\mathbf{26}^2$ . . . $\mathbf{26}^X$ is in-turn coupled to a corresponding one heat exchanger $\mathbf{50}^1$, $\mathbf{50}^2$ . . . $\mathbf{50}^X$, wherein a container, control unit and heat exchanger combination will sometimes be hereinafter referred to as a "flash-chill leg".

The heat exchangers $\mathbf{50}^1$, $\mathbf{50}^2$ . . . $\mathbf{50}^X$ are thermal heat exchangers and require no electricity or other power source to operate. Since the heat exchangers $\mathbf{50}^1$, $\mathbf{50}^2$ . . . $\mathbf{50}^X$ require no electricity, they can be installed in the cooler 12. In the exemplary embodiment, the heat exchanger $\mathbf{50}^1$, $\mathbf{50}^2$ . . . $\mathbf{50}^X$ are plated using Nickel or a Nickel Alloy or other plating materials suitable for food grade products and approved by the National Sanitation Foundation (NSF). Nevertheless, other thermal heat exchangers can be employed that allow for a closed system 10.

In operation, a heat exchanger $\mathbf{50}^1$, $\mathbf{50}^2$ . . . $\mathbf{50}^X$ of a flash-chill leg flash chills the beverage directly after it is siphoned from the corresponding container $\mathbf{16}^1$, $\mathbf{16}^2$ . . . $\mathbf{16}^X$ via a corresponding control unit $\mathbf{26}^1$, $\mathbf{26}^2$ . . . $\mathbf{26}^X$ so that the beverage temperature is rapidly ramped-up to the temperature of the coolant 24 on the return line 32*b* when the beverage exits the heat exchanger $\mathbf{50}^1$, $\mathbf{50}^2$ . . . $\mathbf{50}^X$.

Figure 3A:
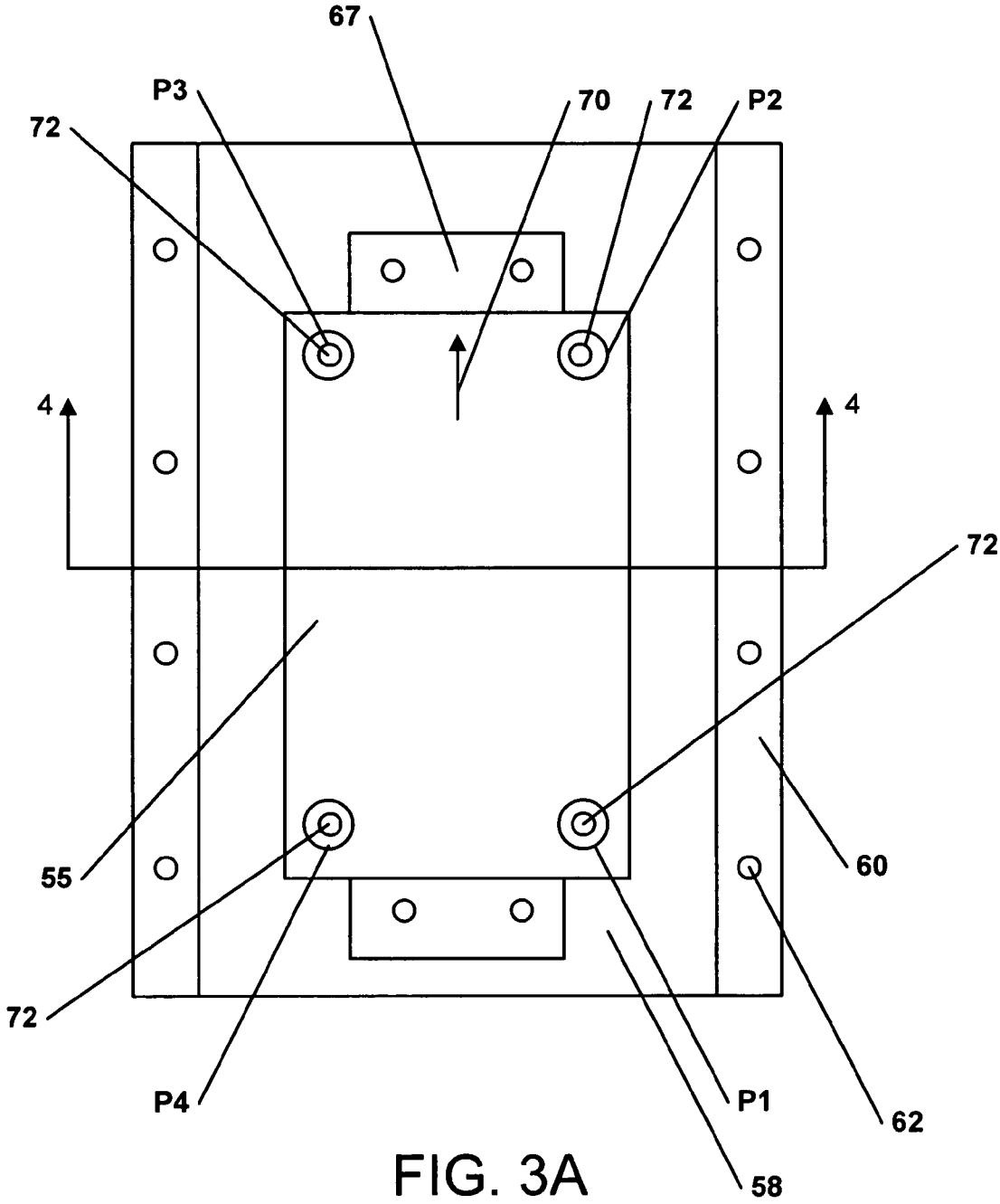
FIG. 3A illustrates the housing of the heat exchanger in accordance with the present invention for installing the heat exchanger in a vertical orientation.
Figure 3B:
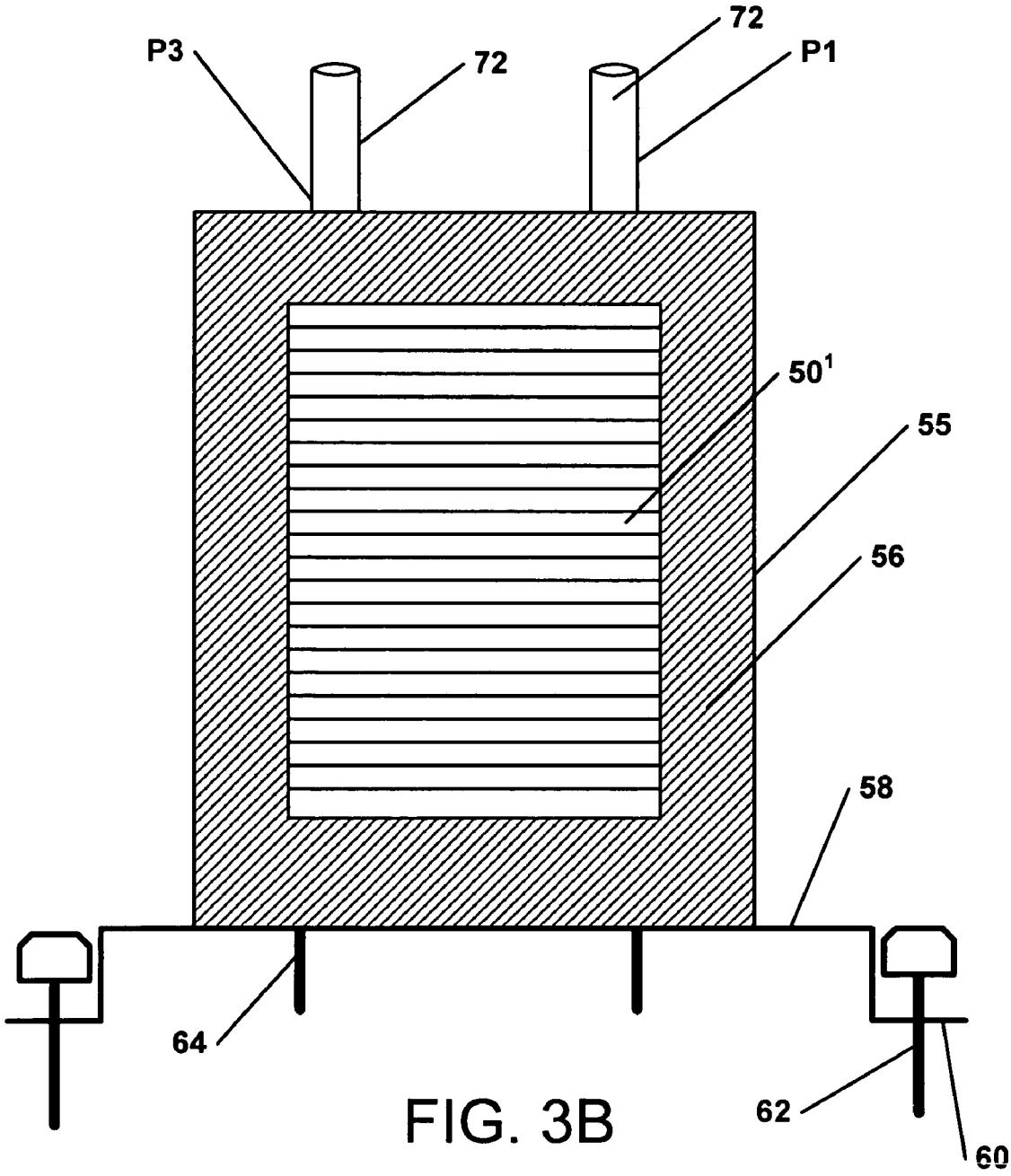
FIG. 3B illustrates a cross-sectional view along the plane 3-3 of FIG. 3A.

Referring also to FIGS. 3A and 3B, since the heat exchangers $\mathbf{50}^1$, $\mathbf{50}^2$ . . . $\mathbf{50}^X$ are essentially the same only one such heat exchanger will be described in detail. The housing 55 which houses a respective one heat exchanger is shown. Housing 55 includes an enclosure for surrounding the heat exchanger 501 on at least five sides, the top side, and front, back, left and right sides. Inside of the housing 55, the heat exchanger 501 is completely incased by insulation 56, such as without limitation, urethane insulation foam.

In the exemplary embodiment, housing 55 is made of metal. The insulation 56 minimizes, if not prevents, condensation from forming on the outside of housing 55 and to prevent heat gain or a loss in BTUs. The insulation 56 also prevents ice from forming on housing 55. The heat exchanger is a non-submersible heat exchanger adapted to be mounted on a vertical wall.

The housing 55 is mounted to an elongated mounting bracket 58 having a top surface. Two parallel sides of the mounting bracket 58 has coupled thereto downwardly depending L-shaped members 60. Each of the L-shaped members 60 has a plurality of spaced apertures formed therein for receipt of fastener 62 (such as a screw or bolt) to fasten the mounting bracket 58 to a vertical wall.

The housing 55 further comprises two flanges 67 extending along the bottom from parallel side of housing 55. Each of the two flanges 67 has formed therein apertures for receipt of fasteners 64 (such as a screw or bolt) which fasten housing 55 to the top surface of mounting bracket 58.

Figure 4B:
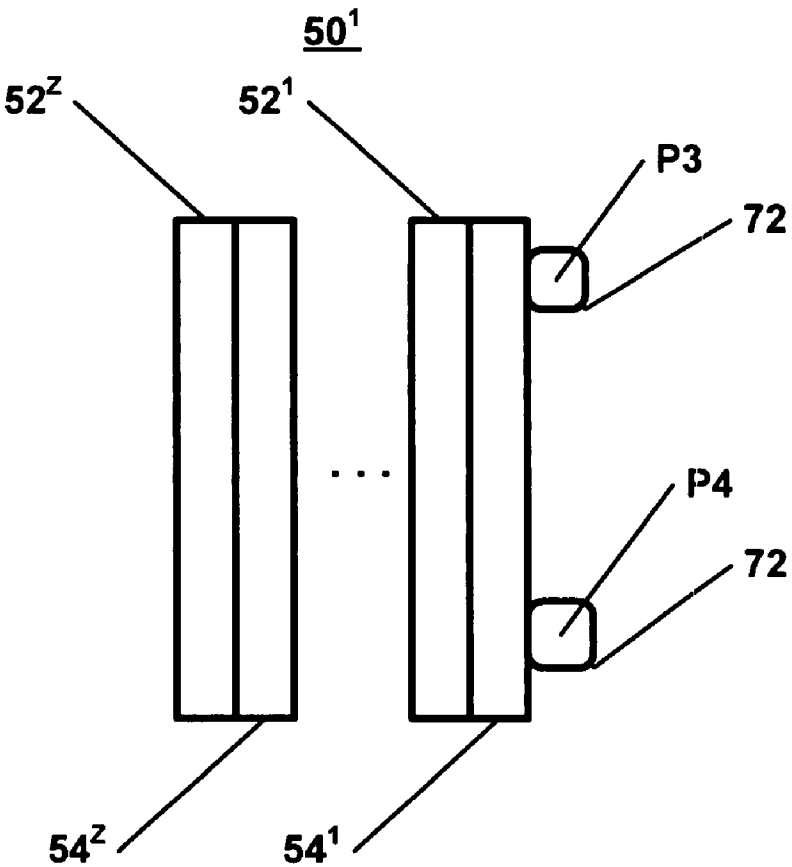
FIGS. 4A and 4B are front and side views of the heat exchanger in accordance with the present invention; and, FIGS. 5A and 5B illustrate a cross-sectional view and perspective view, respectively, of a barb fitting for the heat exchanger.
Figure 4A:
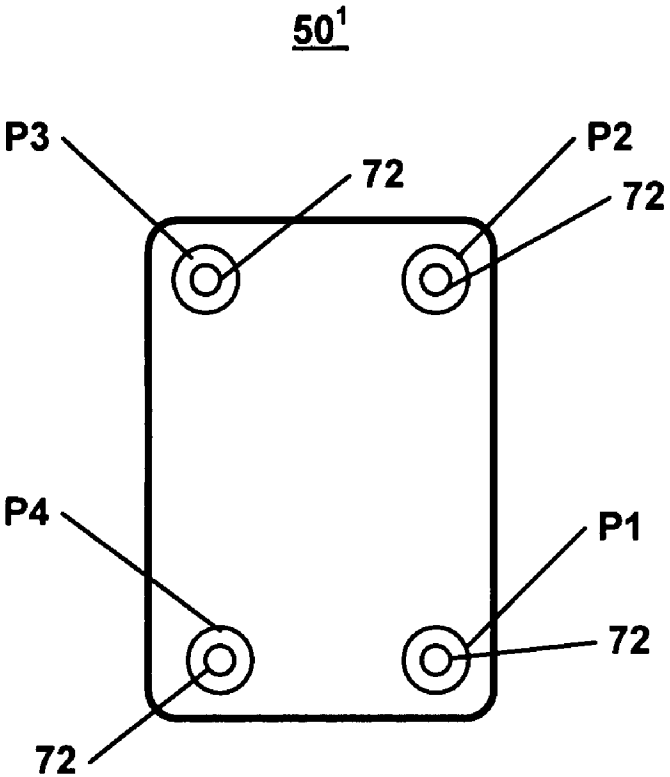

Referring also to FIGS. 4A and 4B, the heat exchanger $\mathbf{50}^1$ has four ports P1, P2, P3 and P4. Ports P1 and P2 are beverage in and out ports, respectively. Ports P3 and P4 are coolant in and out ports, respectively. The heat exchanger $\mathbf{50}^1$ further includes a plurality of coolant divider plates $\mathbf{52}^1$ . . . $\mathbf{52}^Z$ and a plurality of beverage divider plates $\mathbf{54}^1$ . . . $\mathbf{54}^Z$ dividing the coolant 24 and beverage, respectively, into very thin liquid sheets of coolant and very thin sheets of the beverage. The dividing plates in the heat exchanger 501 create a large surface area for rapid heat exchange therebetween as the beverage and coolant passes therein. The heat exchange in the heat exchanger is a first heat exchange stage using the coolant on the return line 32*b*. The beverage exits the heat exchanger $\mathbf{50}^1$ through port P2.

In the exemplary embodiment, the height of the heat exchanger $\mathbf{50}^1$ in housing 55 is approximately 13.875 inches. The width is approximately 5.25 inches. The depth of the exchanger $\mathbf{50}^1$ is approximately 2.0 inches. The weight is approximately 5.0 lbs. As can be readily seen, the heat exchanger is compact and relatively lightweight. The heat exchange $\mathbf{50}^1$ is preferably vertically mounted to a wall in the cooler or outside of the cooler in the direction of indicator arrow 70.

In the preferred embodiment, each of the heat exchangers $\mathbf{50}^1$ . . . $\mathbf{50}^X$ is designed to have a beverage throughput of approximately 16 gallons/hr. (one keg/hr.) for a delta temperature ($\Delta T$) of 18° F. between the input beverage temperature and output beverage temperature, such as, without limitation, 50° F. to 32° F. (beverage temperatures). Each one heat exchanger $\mathbf{50}^1$ . . . $\mathbf{50}^X$ is designed to remove 2296 BTUs. Furthermore, the sum total number of coolant divider plates $\mathbf{52}^1$ . . . $\mathbf{52}^Z$ and beverage divider plates $\mathbf{54}^1$ . . . $\mathbf{54}^Z$ is approximately 22 (Z=11) for the above system parameters. The pump rate of the main chiller 22 is 1.5 gallons/min. As can be appreciated, amount of BTUs removed is a function of all parameters and may fluctuate within a nominal operating range. Furthermore, the flash chill rate of the heat exchanger is 16 gallons/hr. for a beverage temperature of 50° F. On the other hand, for a cooler/beverage temperature of 40° F., the throughput is capable of being increased.

In the exemplary embodiment, a ⅓ horse power (hp) compressor is used for the main chiller 22 when the distance to the tower 90 is between 0 and 150 feet. A ½ hp compressor is used for the main chiller 22 when the distance to the tower 90 is between 150 and 300 feet. A ¾ horse power (hp) compressor is used for the main chiller 22 when the distance to the tower 90 is between 300 and 500 feet. These parameters for the compressor are for a primary trunk that carries up to nine (9) beverage product lines and would vary accordingly.

Figure 5A:
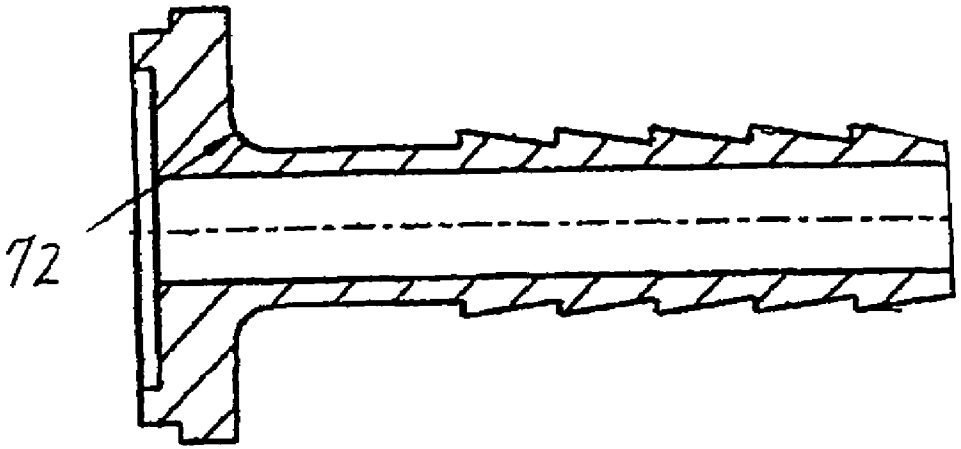
Figure 5B:
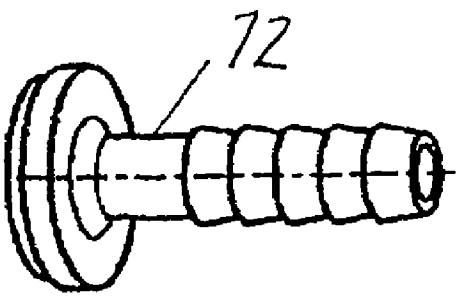

Referring now to FIGS. 5A and 5B, a barb fitting 72 is shown for attachment during the manufacturing process of the heat exchanger to form the exterior connectors of ports P1, P2 and P3 so that the heat exchanger can be daisy chained. The barb fitting 72 is also constructed and adapted to connect to lines or tubing suitable for use in a beverage dispensing system.

Referring now to FIG. 2, the closed and sealed loop configuration for continuously circulating the coolant 24 is shown. The coolant 24' on the supply line 32*a* communicates coolant 24 at a first temperature to the remote dispensing tower 90. The coolant 24 on return line 32*b* enters port P3 of the heat exchanger $\mathbf{50}^1$ and exits heat exchanger 501 on port P4. Thereafter, the coolant 24 exiting on port P4 of heat exchanger $\mathbf{50}^1$ is daisy chained through heat exchangers $\mathbf{50}^2$ . . . $\mathbf{50}^X$, as will be described in more detail later, via polyethylene tubing having a nylon barrier along the interior wall. The tubing 38 is preferably insulated using a sleeve insulation 39, such as, a closed-cell insulation foam. Coolant 24 circulates through heat exchangers $\mathbf{50}^1$, $\mathbf{50}^2$ . . . $\mathbf{50}^X$ continuously. Thus, as the corresponding beverage is dispensed via a spigot at the remote dispensing tower 90, the siphoned beverage from the corresponding container is communicated through the control unit $\mathbf{26}^1$, $\mathbf{26}^2$ . . . $\mathbf{26}^X$ to port P1 of the heat exchanger $\mathbf{50}^1$, $\mathbf{50}^2$ . . . $\mathbf{50}^X$ where it is flash chilled using the coolant 24 circulating on the return line 32*b*.

In the preferred embodiment, the heat exchangers $\mathbf{50}^1$, $\mathbf{50}^2$ . . . $\mathbf{50}^X$ of all legs are daisy chained together wherein the coolant 24 on the return line 32*b* is series coupled through the heat exchangers $\mathbf{50}^1$, $\mathbf{50}^2$ . . . $\mathbf{50}^X$. More specifically, the coolant 24 on the return line 32*b* enters the heat exchanger 501 of the first leg. The heat exchanger of the first leg will hereinafter be referred to as the first heat exchanger. As circulating coolant exits the first heat exchanger on port P4, the coolant enters the heat exchanger $\mathbf{50}^2$ of an immediately adjacent leg (the second leg) on port P3. The heat exchanger $\mathbf{50}^2$ of the second leg will hereinafter be referred to as the second heat exchanger. The coolant exiting the second heat exchanger on port P4 enters the heat exchanger of the third leg on port P3. This process repeats for the remaining legs and heat exchangers of the system 10. The coolant 24 exiting the last leg is communicated out to the source of coolant 24, via return line 32*b*, at the main chiller 22 where it is cooled via an evaporator (NOT SHOWN) to the predetermined temperature set for the primary cooling function.

Typically, the supply line 32*a* and return line 32*b* are passed through the cooler housing via a jumper line (NOT SHOWN) so that they are coupled to the primary trunk 30 with the beverage lines $\mathbf{34}^1$, $\mathbf{34}^2$ . . . $\mathbf{34}^X$.

While not wishing to be bound by theory, in lieu of using the coolant from the return line to daisy chain the coolant through the heat exchangers, the coolant from the supply line can be used. However, the use of the supply line coolant may not be as efficient as using the return line.

The main chiller 22 of system 10 monitors the return temperature of the coolant 24 on the return line 32*b* so that the coolant on the supply line 32*a* is approximately 27° F.-29° F. When glycol coolant is kept at a mid-twenty range, additional heat exchange takes place between the supply line 32*a* and the beverage lines $\mathbf{34}^1$, $\mathbf{34}^2$ . . . $\mathbf{34}^X$ as it travels to tower 90. The main chiller 22 has a quicker response time and is more efficient for the load with the use of heat exchangers $\mathbf{50}^1$, $\mathbf{50}^2$ . . . $\mathbf{50}^X$.

Generally, a minimum cooling distance between the cooler 12 and dispensing tower 90 is required to chill the dispensed beverage to 32° F. using the heat exchange properties of a trunked bundle of prior art systems. Heat exchange takes place over the distance traveled by coolant 24 and the beverage in heat exchange relationship, between the cooler 12 and dispensing tower 90. While not wishing to be bound by theory, the minimum cooling distance is approximately 75 feet to reduce the beverage temperature to 32° F. (or less) when cooler 12 has a temperature of 40° F.

However, the flash-chill leg configuration of the present invention allows the minimum cooling distance to be significantly reduced, if not eliminated. More specifically, if the main chiller 22 cools coolant 24 circulating in coolant supply line 32*a* to 27° F.-29° F. with a cooler temperature of 40° F. or above, the minimum cooling distance is as little as 1 ft. In effect, the minimum cooling distance is eliminated such that the distance between cooler 12 to remote dispensing tower 90 is not a significant factor when designing a system using primary trunk technology for reducing the beverage temperature through heat exchange with a coolant 24.

While not wishing to be bound by theory, during stead state conditions, the loading on main chiller 22 is reduced since the beverages entering the beverage lines $\mathbf{34}^1$, $\mathbf{34}^2$ . . . $\mathbf{34}^X$ of the primary trunk 30 are only a few degrees warmer than the coolant 24 circulating along the coolant supply line 32*a*. This reduces the run time on the main chiller 22 and the set point of the beverage (beer) temp is achieved quicker. Furthermore, the temperature of the coolant 24 circulating in the coolant supply line 32*a* is not affected by the flash chilling by heat exchangers $\mathbf{50}^1$, $\mathbf{50}^2$ . . . $\mathbf{50}^X$.

In the exemplary embodiment, the main chiller 22 uses a plated evaporator which is significantly smaller in size than the double pass copper evaporator. In the exemplary embodiment, only one main chiller 22 can be used to accommodate a system with 1-20 different product lines.

In real time operation of the system 10, the temperature of the cooler 12 fluctuates. For example, at peak operating hours, the cooler's temperature may rise to 50° F.-60° F. Hence, the temperature of the beverages in containers $\mathbf{16}^1$, $\mathbf{16}^2$ . . . $\mathbf{16}^X$ is reduced during peak operating hours. While not wishing to be bound by theory, under peak operating conditions, the cooling distance of prior art systems (the distance the coolant and beverage must travel in heat exchange relationship in primary trunk 30) may increase to 200 ft. Thereby, the beverage temperature is often times warmer than desired which produces foam and waste.

The flash-chill leg configuration of the present invention nullifies the effects of temperature fluctuations of the cooler 12 even at peak operating times of a restaurant, bar or the like. Thereby, the installed length of the primary trunk 30 only needs to be the distance between the cooler 12 and the remote dispensing tower 90 and can be as little as 1 ft. and a long as 500 ft without creating foam at the spigot.

In view of the numerous modifications which could be made to the preferred embodiments disclosed herein without departing from the scope or spirit of the present invention, the details herein are to be interpreted as illustrative and not in a limiting sense.

What is claimed is:

1. A closed cooling and remote dispensing system for dispensing a plurality of beverages, each beverage may be alcoholic or non-alcoholic and is stored in a corresponding container remote from a dispensing tower, comprising:

a main chiller for chilling a coolant for circulation in a closed and sealed loop to and from said tower;

a primary trunk coupled in said closed and sealed loop, said primary trunk bundling supply and return lines of said coolant and product lines for delivering the plurality of beverages in heat exchange relationship with said coolant to said tower; and, a heat exchanger coupled in said closed and sealed loop and in fluid communication to receive a corresponding one beverage for flash chilling a temperature of the corresponding one beverage to a temperature of the coolant in said closed loop before the corresponding one beverage enters a corresponding one product line of said primary trunk, said heat exchanger is a first heat exchanger of a plurality of heat exchangers, wherein each heat exchanger of said plurality of heat exchangers receives a corresponding different one beverage for independently flash chilling a temperature of the corresponding different one beverage to the temperature of the coolant in said close loop before the corresponding one different beverage enters a corresponding different one product line of said primary trunk.

2. The system according to claim 1, wherein:

the temperature of said coolant is a temperature of the return line of said coolant; and, said coolant is a food grade coolant and continuously circulates in said closed and sealed loop.

3. The system according to claim 1, wherein:

the temperature of said coolant is a temperature of the supply line of said coolant; and, said coolant is a food grade coolant and continuously circulates in said closed and sealed loop.

4. The system according to claim 1, wherein:

said first heat exchanger comprises a coolant-in port adapted to receive the coolant from the closed and sealed loop and a coolant-out port daisy chained to the coolant-in port of an adjacent heat exchanger of said plurality heat exchangers; and, remaining heat exchangers of said plurality of heat exchangers are daisy chained to it's corresponding adjacent heat exchanger; and, a last heat exchanger outputs from its coolant-out port said coolant to said closed and seated loop.

5. The system according to claim 1, wherein:

each of said plurality of heat exchangers is adapted to be installed in a cooler and has a beverage throughput of approximately 16 gallons/hr. for a delta temperature of 18° F. for input and output beverage temperatures; and, wherein said main chiller has a pump rate of 1.5 gallons/min.

6. The system according to claim 1, wherein:

said heat exchanger comprises a plurality of plated dividers spreading said coolant and said corresponding one beverage into thin sheets of liquid; and, said plurality of plated dividers are plated using Nickel, a Nickel Alloy or other plating materials suitable for food grade products approved by the National Sanitation Foundation (NSF).

7. The system according to claim 1, wherein said each heat exchanger is a non-submersible heat exchanger which is foam insulated and adapted to be vertically mounted on a wall in a cooler.

8. The system according to claim 1, wherein:

said corresponding one beverage is carbonated;

flash chill comprises chilling said corresponding one beverage at a rate of at least 16 gallons/per hr.;

said coolant on said supply line is in the range of 27° F. to 29° F.;

said corresponding one beverage is delivered at 32° or less; and, a distance between said tower and said container is within the range of 1 to 500 ft.

9. A method of cooling and remote dispensing a plurality of beverages, each beverage may be alcoholic or non-alcoholic and is stored in a corresponding container remote from a dispensing tower, comprising the steps of:

chilling a coolant for circulation in a closed and sealed loop;

circulating said coolant in a closed and sealed loop;

heat exchanging, in said closed and sealed loop, a bundle of supply and return lines of said circulating coolant and product lines of the plurality of beverages to the tower;

flash chilling a temperature of a corresponding one beverage to a temperature of the circulating coolant flowing in said closed and sealed loop;

independently flashing chilling, a corresponding different one beverage for flash chilling a temperature of the corresponding different one beverage to the temperature of the circulating coolant daisy chained in said closed loop before the corresponding one different beverage enters a corresponding different one product line of said primary trunk; and, repeating the step of independently flash chilling for at least some of the plurality of beverages.

10. The method according to claim 9, wherein:

said flash chilling step takes place before the corresponding one beverage enters a corresponding one product line;

the temperature of said coolant is a temperature of the return line of said coolant; and, said circulating step comprises the step of:

continuously circulating said coolant in said closed and sealed loop.

11. The method according to claim 9, wherein:

said flash chilling step takes place before the corresponding one beverage enters a corresponding one product line;

the temperature of said coolant is a temperature of the supply line of said coolant; and, said circulating step comprises the step of:

continuously circulating said coolant in said closed and sealed loop.

12. The method according to claim 9, wherein the step of flash chilling comprises the steps of:

flash chilling said corresponding one beverage at a rate of approximately 16 gallons/hr. for a delta temperature of 18° F.

13. The method according to claim 9, wherein said flash chilling comprises:

spreading said coolant and said corresponding one beverage into thin sheets of liquid; and, throughputting the spreaded beverage at a rate of at least 16 gallons/hr.

* * * * *